US007921602B2

(12) United States Patent
Ohanesian

(10) Patent No.: US 7,921,602 B2
(45) Date of Patent: Apr. 12, 2011

(54) SHUTTER ASSEMBLY

(75) Inventor: Viken Ohanesian, San Juan Capistrano, CA (US)

(73) Assignee: U.S. Polymers, Inc., Montebello, CA (US)

( * ) Notice: Subject to any disclaimer, the term of this patent is extended or adjusted under 35 U.S.C. 154(b) by 53 days.

(21) Appl. No.: 11/304,080

(22) Filed: Dec. 15, 2005

(65) Prior Publication Data

US 2007/0137108 A1 Jun. 21, 2007

(51) Int. Cl.
*E06B 7/08* (2006.01)

(52) U.S. Cl. ..... 49/403; 49/90.1; 49/74.1

(58) Field of Classification Search ..... 49/82.1, 49/80.1, 74.1, 90.1, 87.1, 403, 73.1; 52/473; 454/277, 278, 280, 201, 309
See application file for complete search history.

(56) References Cited

U.S. PATENT DOCUMENTS

| | | | | | |
|---|---|---|---|---|---|
| 535,871 | A | * | 3/1895 | Taylor | 49/403 |
| 2,926,729 | A | | 3/1960 | Zanini | |
| 3,110,936 | A | | 11/1963 | Berard | |
| 3,691,687 | A | * | 9/1972 | Economou | 49/74.1 |
| 4,469,132 | A | | 9/1984 | Redington | |
| 4,481,701 | A | | 11/1984 | Hewitt | |
| 4,722,382 | A | | 2/1988 | Vecchiarelli | |
| 5,191,735 | A | * | 3/1993 | Ross | 49/74.1 |
| 5,339,591 | A | * | 8/1994 | Underdahl | 52/473 |
| 5,778,598 | A | | 7/1998 | Ohanesian | |
| 5,826,393 | A | | 10/1998 | Wenzlaff et al. | |
| 5,941,021 | A | | 8/1999 | Valls, Jr. et al. | |
| 5,996,672 | A | | 12/1999 | Kotin | |
| 6,125,906 | A | | 10/2000 | Kotin | |
| 6,219,985 | B1 | * | 4/2001 | Hsu | 52/473 |
| 6,263,632 | B1 | * | 7/2001 | Cadorette | 52/473 |
| 6,328,090 | B1 | | 12/2001 | Anderson et al. | |
| 6,357,197 | B1 | | 3/2002 | Serino et al. | |
| 6,655,091 | B1 | | 12/2003 | Iwasaki | |
| 6,817,141 | B2 | * | 11/2004 | Chen | 49/87.1 |
| 6,854,211 | B1 | | 2/2005 | Blachley | |
| 2001/0037603 | A1 | | 11/2001 | Gabriele | |
| 2001/0037604 | A1 | | 11/2001 | Gabriele | |
| 2002/0056231 | A1 | | 5/2002 | Blachley | |
| 2004/0025438 | A1 | | 2/2004 | Marocco | |
| 2005/0005523 | A1 | | 1/2005 | Johnston | |
| 2005/0045280 | A1 | | 3/2005 | Schlater et al. | |
| 2005/0102963 | A1 | | 5/2005 | Nien et al. | |
| 2005/0103451 | A1 | | 5/2005 | Nien | |
| 2005/0126719 | A1 | | 6/2005 | Null | |
| 2006/0070300 | A1 | * | 4/2006 | Gabriele | 49/403 |

* cited by examiner

*Primary Examiner* — Gregory J. Strimbu
(74) *Attorney, Agent, or Firm* — Vic Lin; Innovation Capital Law Group, LLP

(57) ABSTRACT

A shutter assembly includes a stile having a solid core and a plastic outer cover. Holes are formed in the plastic outer cover and aligned with an axial groove formed in the solid core to receive a slotted louver pin. The louver pin includes a pair of arms that provide a sufficient compression fit in the axial groove of the stile while enabling each louver to rotate freely. Separate stile end caps are formed to be flush with the edges of the ends of the plastic cover. Each louver includes louver edges and opposite end caps which are substantially flush with the louver edges. A method of manufacturing a shutter assembly is also provided.

9 Claims, 5 Drawing Sheets

SHUTTER ASSEMBLY

BACKGROUND OF THE INVENTION

1. Field of the Invention

The present invention relates generally to shutter assemblies.

2. Description of Prior Art and Related Information

Shutter assemblies are often selected as the window treatment of choice for homes. Shutters may also be used to dress a screen door or any other fenestration in a building that includes a glass or window. Plastic shutter assemblies serve as an alternative to conventional wooden shutter assemblies. The cheaper costs, durability and varying options associated with plastic shutter assemblies make such products preferable to wooden shutters for many customers.

While plastic shutters may be cheaper than wooden shutters, plastic shutters according to the prior art do require a plurality of parts for assembly and operation. The visibly higher number of parts creates an overall appearance of a cheaper imitation product and thus imparts a sense of lower quality to the consumer.

Though plastic shutters may be less expensive and longer lasting than wooden shutters, many customers still prefer wooden shutters primarily on the basis of the look and feel of wooden shutters. Plastic shutters in the prior art look and feel, quite simply, plastic due to the visible plurality of components, such as protruding louver and stile end caps, and strips of components clipped together like LEGO® parts. And, many such shutters in the prior art are much lighter than wooden shutters which give these products a cheaper feel. Since it is generally known that wooden shutters are more expensive and thus considered high end, customers naturally prefer that anyone who encounters their plastic shutters would not be able to tell the difference.

Therefore, plastic shutters that more closely resemble wooden shutters in both look and feel, while having reduced costs and complexities, would be highly desirable.

SUMMARY OF THE INVENTION

The present invention provides structures and methods which overcome the deficiencies in the prior art.

In one aspect, a shutter assembly is provided. The assembly comprises a stile that defines a longitudinal axis and includes a plastic cover and an inner solid core. The inner core defines an axial groove extending parallel to the longitudinal axis. The axial groove defines a fixed width that is uniform throughout its length. A louver is rotatably coupled to the stile. The louver has a slotted louver pin that is received in the axial groove of the inner core of the stile.

The louver further comprises a louver body with a louver edge, and a louver end cap with an outer louver planar surface. The louver end cap is coupled to the louver body such that the louver planar surface is substantially flush with the louver edge. The louver end cap comprises a closed loop wall and a louver lip that extends radially outward from the closed loop wall. The louver body comprises an inner shoulder configured to support the louver lip such that the louver planar surface is substantially flush with the louver edge.

The stile cover comprises a stile edge. The stile end cap with an outer stile planar surface. The stile end cap is coupled to the stile body such that stile planar surface is substantially flush with the stile edge. The stile end cap comprises a closed loop wall and a stile lip that extends radially outward from the closed loop wall. The stile body comprises an inner shoulder configured to support the stile lip such that the stile planar surface is substantially flush with the stile edge.

The louver pin comprises a pair of arms and a slot defined therebetween. The inner core of the stile is composed of wood. The cover defines a plurality of apertures open to the axial groove In another aspect, a shutter assembly comprises an end cap and a tubular body. The end cap has a peripheral lip and an outer planar surface. The tubular body has at least one edge and an inner shoulder adjacent to the edge. The inner shoulder is configured to support the lip of the end cap such that the planar surface is substantially flush with the edge. The end cap further comprises a closed loop wall extending oppositely from the outer planar surface. The closed loop wall forms a press fit with an inner surface of the tubular body. The end cap comprises a louver end cap or a stile end cap. The tubular body comprises a louver body or a stile body. The assembly may further comprise a solid core disposed within the tubular body. The solid core may be composed of wood or wood composites.

In a further aspect, a shutter assembly comprises a stile defining a longitudinal axis and including a plastic cover and an inner wood core. The inner wood core defines an axial groove extending parallel to the longitudinal axis. The cover comprises a planar longitudinal section that is spaced apart from the axial groove of the inner wood core. The planar longitudinal section defines at least one aperture open to the axial groove. A louver is rotatably coupled to the stile. The louver has a louver pin received in the axial groove of the inner core of the stile.

The stile comprises a stile body with a stile edge, and a stile end cap that is substantially flush with the stile edge. The louver further comprises a louver body with a louver edge, and a louver end cap that is substantially flush with the louver edge. The louver pin is slotted.

A method of manufacturing a shutter assembly is also provided. The method comprises providing a stile with a plastic cover and a wood core having an axial groove, providing a louver with a slotted louver pin, and coupling the louver to the stile by inserting the slotted louver pin into the axial groove of the wood core.

The method further comprises covering an end of the wood core with a stile end cap that is substantially flush with an edge of the plastic cover. The step of providing the louver with the louver pin comprises providing a louver edge and a louver end cap that is substantially flush with the louver edge. The method further comprises forming an aperture in the plastic cover that is open to the axial groove.

In summary, a shutter assembly includes a stile having a solid core and a plastic outer cover. Holes are formed in the plastic outer cover and aligned with an axial groove formed in the solid core to receive a slotted louver pin. The louver pin includes a pair of arms that provide a sufficient compression fit in the axial groove of the stile while enabling each louver to rotate freely. Separate stile end caps are formed to be substantially flush with the edges of the ends of the plastic cover. Each louver includes louver edges and opposite end caps which are substantially flush with the louver edges. A method of manufacturing a shutter assembly is also provided.

The invention, now having been briefly summarized, may be better appreciated by the following detailed description.

DETAILED DESCRIPTION OF THE PREFERRED EMBODIMENTS

The invention and its various embodiments can now be better understood by turning to the following detailed description wherein illustrated embodiments are described. It is to be expressly understood that the illustrated embodiments are set forth as examples and not by way of limitations on the invention as ultimately defined in the claims.

Figure 1:
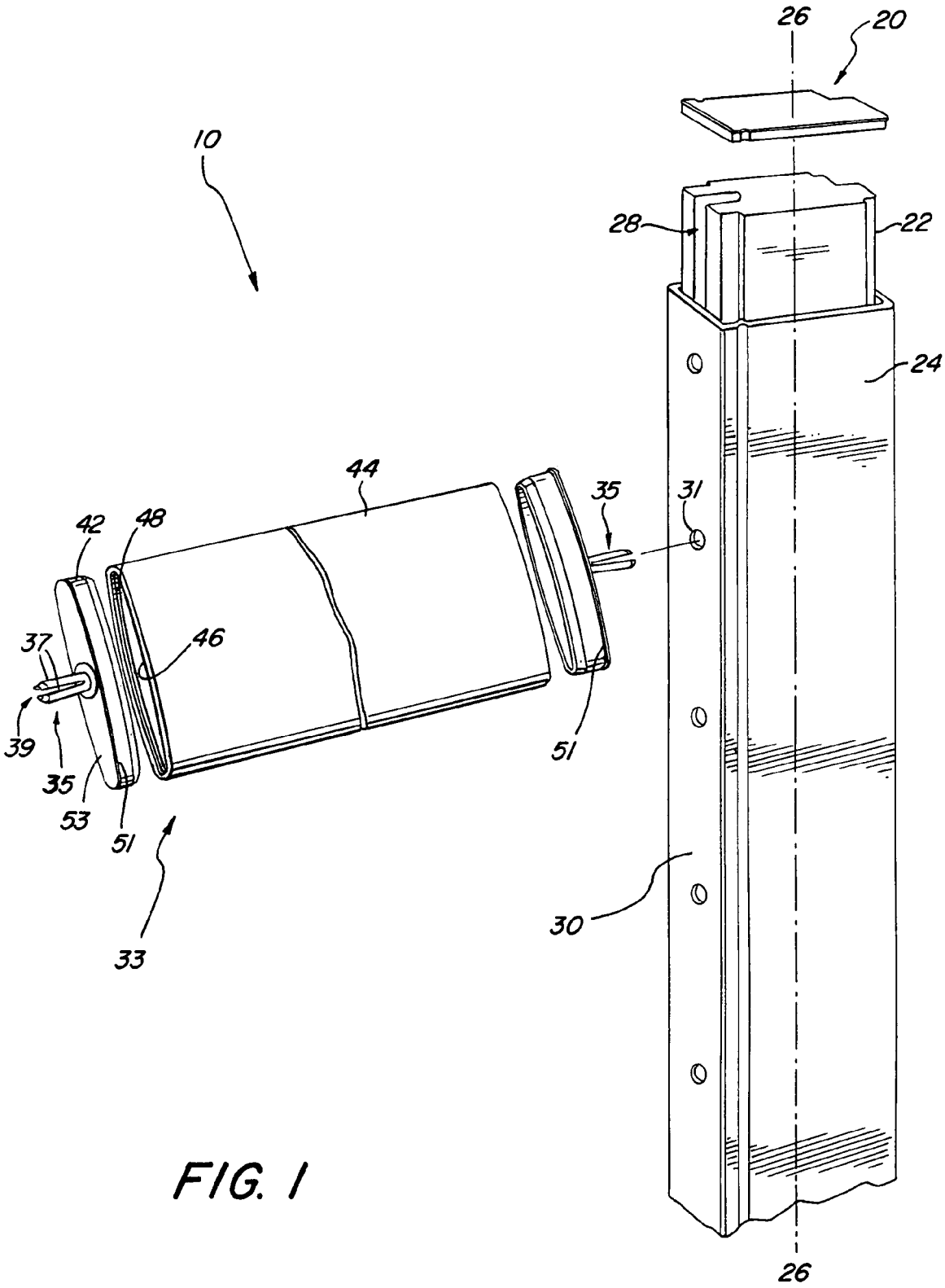
FIG. 1 is an exploded, perspective view of a first preferred embodiment of a shutter assembly according to the invention.

In FIG. 1, a preferred embodiment of a shutter assembly is illustrated and designated generally by the reference numeral 10. The shutter assembly, or simply shutter, 10 comprises at least one preferred elongate stile 20. In the preferred embodiment, the stile 20 comprises a solid core 22 and an outer thin cover, or stile body, 24. The elongate stile 20 defines a longitudinal, or vertical, axis 26. The core 22 is preferably composed of wood or wood composites, but may also be composed of any natural or synthetic material of substantial weight and density to provide the stile 20 with the weight and feel of a natural wood stile. Hereafter, the term "wood" shall include both natural wood and wood composites. The stile core materials may include, without limitation, any other material of sufficient density so as to provide the weight, and thus the feel and impression, of an all wood stile.

The outer cover 24 is preferably preformed separately from the core 22, and is preferably composed of a plastic material, such polyvinyl chloride (PVC) or unplasticized polyvinyl chloride (UPVC). Since the outer cover 24 is configured to cover the elongate stile core 20, the outer cover 24 is also elongate and generally shaped as a tube. The outer cover 24 is preferably composed of a material that can be extruded in the manufacturing process.

Figure 3:
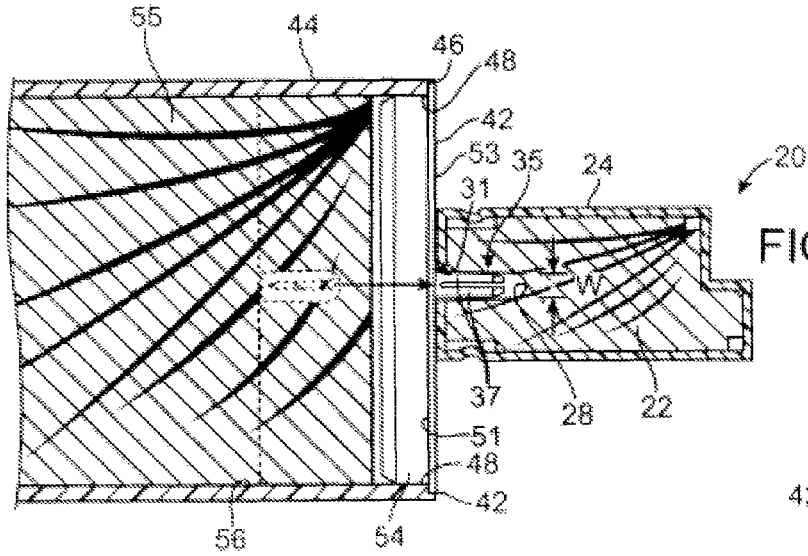
FIG. 3 is a cross-sectional view of the preferred embodiment of the shutter assembly including a preferred stile and louver pin.

Of particular interest, the stile 20 comprises an axial, or longitudinal, groove 28 adapted to receive a louver end pin according to the invention. The groove 28 is defined along a side of the stile core 22 and extends parallel to the longitudinal axis 26. The groove 28 is shaped to receive a preferred slotted louver pin as shown in FIG. 3. The outer cover 24 comprises a planar longitudinal section 30 that covers the groove 28 of the core 22. Accordingly, the inner surface of the planar longitudinal section 30 is spaced apart from the groove 30. The planar longitudinal section 30 defines a plurality of apertures 31 for receiving a preferred slotted louver pin. By forming an axial groove 28 that extends substantially along a length "L" of the stile 20, it will be appreciated that adjustability of the shutter assembly 10 is greatly enhanced. Whereas louvers in prior art shutters had to be coupled to the stile in predetermined locations, the axial groove 28 of the stile 20 according to the invention enables louvers to be coupled thereto anywhere along said groove 28. In particular, the apertures 31 need to be simply formed in the planar longitudinal section 30 of the cover 24 at locations where louvers are desired to be coupled.

Figure 2:
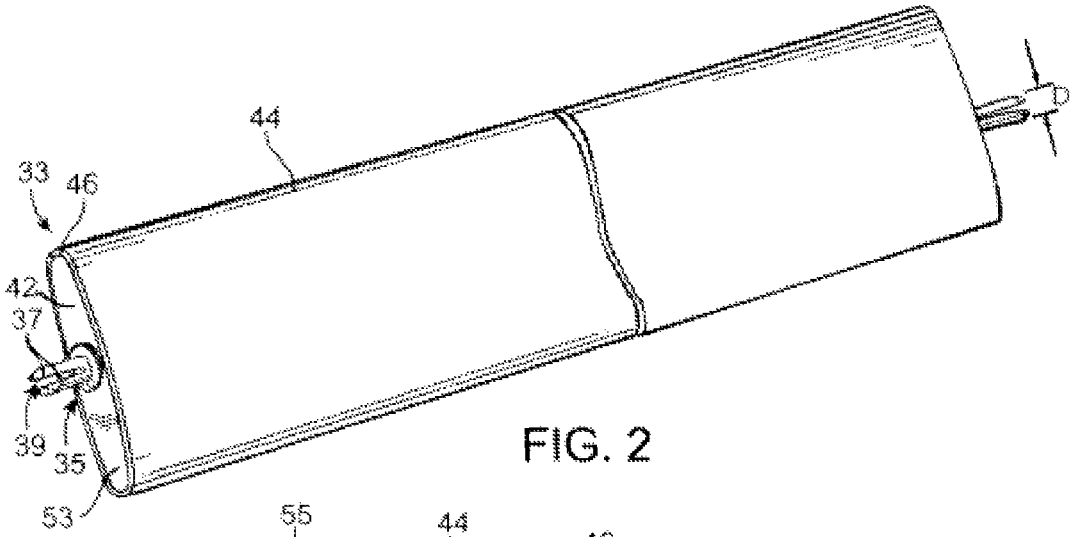
FIG. 2 is a perspective view of the louver in FIG. 4.

In FIGS. 1 and 2, a preferred louver 33 comprises at least one louver pin 35 having a pair of arms 37 with a slot 39 defined therebetween. In the preferred embodiment, the louver pin 35 is formed as part of a louver end cap 42 which is also of particular interest to the invention. In a rest state, the arms 37 define a diameter, or cross-dimension, D. Optionally, the arms 37 may be slightly flared outwardly away from each other as they extend from an outward facing louver planar surface 53 of the louver end cap 42 so as to define an even larger cross-dimension D.

In FIG. 3, the slotted louver pin 35 makes it easy to couple the louver 33 to the stile 20, and to provide a sufficiently tight fit such that the louver 33 does not rotate too loosely. In particular, the arms 37 are inserted through the aperture 31 of the outer cover 24 and then into the groove 28 defined in the core 22, where the arms 37 are compressed by the walls defining the axial groove 28. The groove 28 is formed with a fixed width W that is preferably slightly less than the diameter D of the arms 37 in the rest state. The width W is uniform throughout the length of the groove 28.

It will be appreciated that a secure fit is accomplished with minimal complexity. In particular, a sufficiently tight compression fit is accomplished with an axial groove 28 having a fixed width W throughout its length that receives a slightly larger, but compressible louver pin 35. The slot 39 between the arms 37 thus makes the louver pin 35 compressible, or resilient, namely, that the arms 37 may be compressed toward each other in order to maintain a compression fit when the louver pin 35 is inserted into the narrower groove 28. This accomplishes the tightness, or tensioning, desired between a louver and a stile so that the louver may rotate freely, but not loosely, with respect to the stile. An even tighter fit may be accomplished by slightly flaring out the arms 37 so as to define a larger cross-dimension D in the rest state such that greater compression results when the louver pin 35 is inserted into the groove 28.

It will further be appreciated that forming the louver pin 35 with a slot is one preferred embodiment of making the louver pin 35 expandable and compressible in order to form a tight fit with a groove of fixed width. A variety of other mechanisms may be utilized to make the louver pin 35 springy or compressible, including, but not limited to: forming the pin 35 out of a compressible, cushion-type material; employing various spring-like designs, such as radially expandable louver pins, etc.

The ease of manufacturing and assembly will be appreciated with the louver pin according to the invention. By employing a combination of a slotted pin 35 in the louver 33 and an axial groove 28 in the stile 20, a plurality of complex intermediate mechanisms associated with the prior art may be avoided.

In FIGS. 1 and 2, the louver 33 includes an elongate louver body 44 with opposing louver edges 46. In the preferred embodiment, the elongate body 44 is hollow, although it may also be filled with a core material to provide greater weight so as to resemble an all wood louver. An inner shoulder 48 is located within the elongate body at a depth sufficient to support a peripheral louver lip, or fringe, 51 of the louver end cap 42 such that a louver planar surface 53 is flush with the louver edge 46. In order to accomplish the flush feature, the depth of the shoulder 48 from the louver edge 46 is substantially equal to the thickness of the lip 51. In particular, as shown in FIGS.

2 and 3, the outward facing louver planar surface 53 of the louver end cap 42 is flush with the louver edge 46 when the lip 51 rests on the shoulder 48 within the louver body 44. Such a feature is desirable in that any "seams" or lines between the louver end cap 42 and the louver body 44 is hidden or, at least, less visible from a front view, namely, the view that an observer would primarily see when standing in front of the shutter assembly 10. This presents the impression that the louver is composed of an integral solid piece of expensive material, such as wood, when in fact the louver 33 is composed of multiple plastic parts. Since wood is typically perceived as a more expensive and luxurious material for shutter assemblies, it would be desirable to hide the fact that the louver is composed of separate pieces by hiding features such as lines, breaks, seams, etc.

To facilitate a tight fit between the louver end cap 42 and the louver body 44, the louver end cap 42 includes a closed loop wall 54 that forms a tight press fit with an inner surface 56 of the louver body 44 that is medial to the shoulder 48 as shown in FIG. 3. The periphery of the wall 54, which may be tubular or filled with material to give greater weight, is retracted with respect to the lip 51 such that the lip 51 protrudes radially with respect to the wall 54 in order to form a fringe to rest upon the shoulder 48. This facilitates the flush feature between the louver edge 46 of the louver body 44 and the louver planar surface 53 of the end cap 42 so as to conceal the multiplicity of parts.

In the preferred embodiment, the louver 33 comprises a pair of louver end caps 42 on opposite ends, each end cap 42 including an associated slotted louver pin 35 such that the louver 33 is coupled to a first stile on one side and a second stile on an opposite side. Accordingly, the louver body 44 preferably includes a pair of shoulders 48, one located medially with respect to each louver edge 46. It is to be expressly understood that a shutter assembly according to the invention would also comprise top and bottom frames. Such structures have been omitted from view in the Figures to better illustrate the novel features according to the invention.

Figure 4:
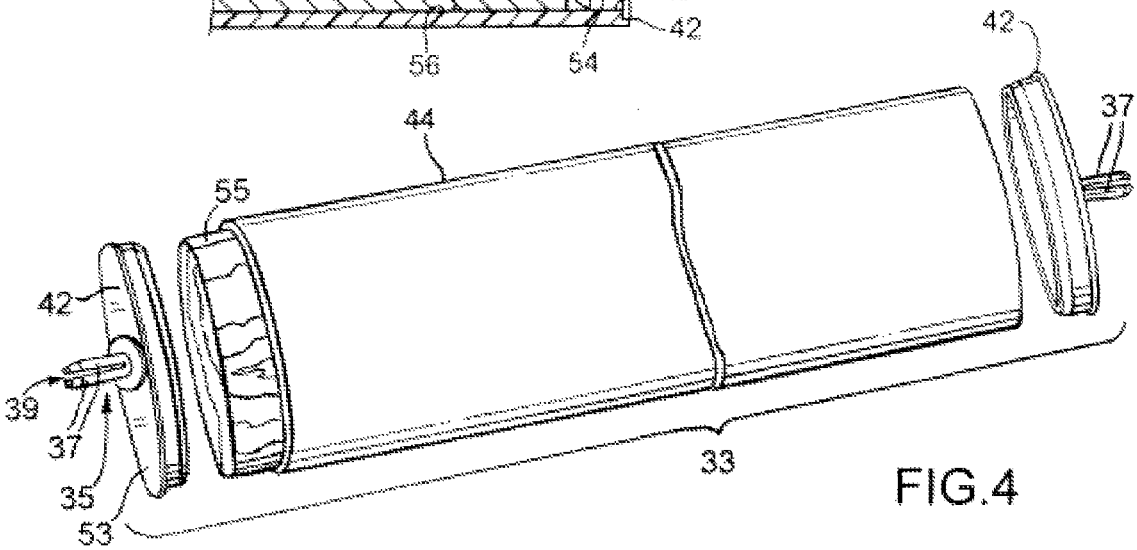
FIG. 4 is an exploded, perspective view of a louver with a preferred louver end cap.

In an alternative embodiment illustrated in FIG. 4, the louver 33 may comprise a solid inner core 55 to give the louver the weight, and thus the feel, of an all wood louver. The inner core 55 of the louver 33 may comprise wood, a wood composite or any other materials having a sufficient density to give the louver 33 the weight and, thus the feel, of an all wood louver.

The preferred stile 20 according to the invention is configured to appear and feel as if it was a single integral piece entirely composed of expensive wood. The feel of wood is accomplished with the wooden inner core 22 as discussed above and shown in FIGS. 1, 5 and 6, which gives the stile 20 a heavier weight than a hollow plastic stile. It will be appreciated that the preferred stile 20 according to the invention may have a weight that is substantially indistinguishable from that of an all wood stile.

Figure 5:
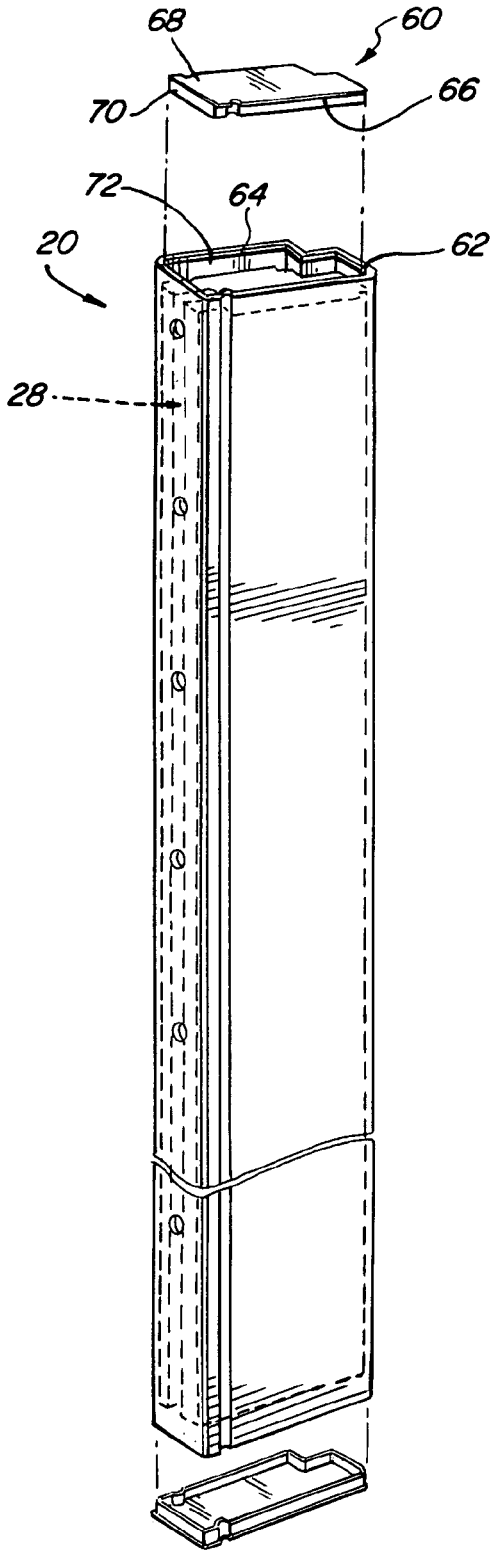
FIG. 5 is an exploded, perspective view of a stile with a preferred stile end cap.
Figure 6:
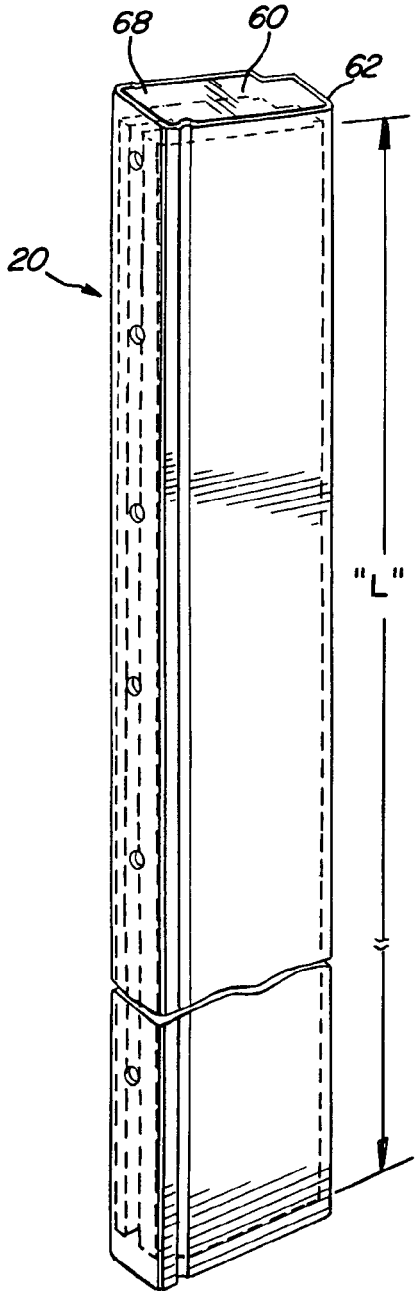
FIG. 6 is a perspective view of the stile in FIG. 5.
Figure 7:
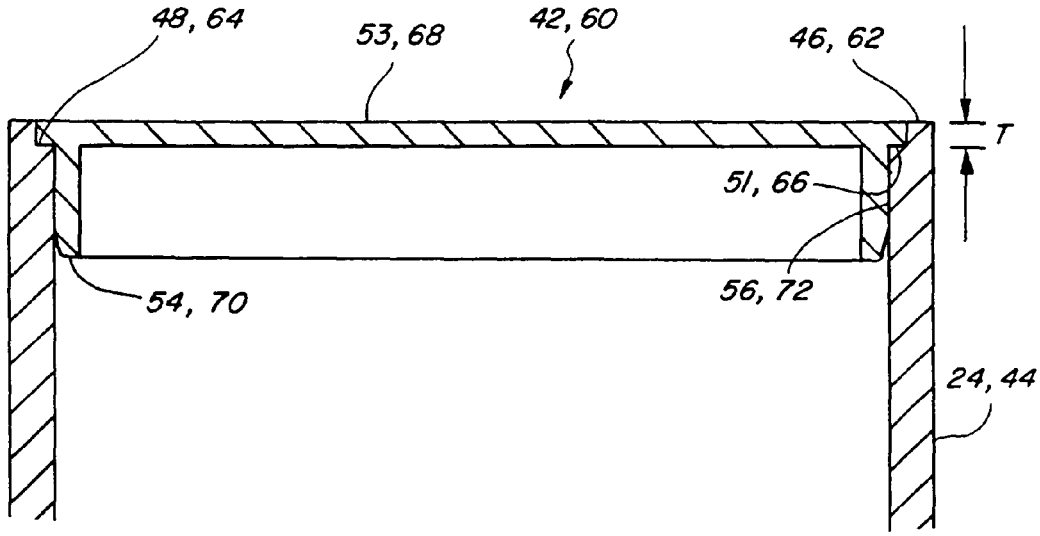
FIG. 7 is a close-up cross-sectional view illustrating a flush feature of the stiles and louvers according to a preferred embodiment of the invention.

In FIGS. 5 and 6, the stile 20 is provided with a more luxurious, high-end appearance by hiding breaks and lines from a front view that would otherwise suggest a plurality of plastic parts. Thus, the stile 20 comprises at least one stile end cap 60 of particular interest. In FIGS. 5-7, the cover 24 of the stile 20 has opposite stile edges 62, one at each end. An inner shoulder 64 is located within the cover 24, medial to the stile edge 62, at a depth sufficient to support a stile lip, or fringe, 66 of the stile end cap 60 such that the stile end cap 60 is flush with the stile edge 62. Similar to how the flush feature is accomplished with the louvers 33, the depth of the shoulder 64 from the stile edge 62 is substantially equal to the thickness of the lip 66. In particular, an outward facing stile planar surface 68 of the stile end cap 60 is flush with the stile edge 62 when the lip 66 rests on the shoulder 62 within the cover 24.

By making the stile end cap 60 flush with the stile edges 62, it will be appreciated that lines or seams are less visible from a front view, thereby avoiding the appearance of a multiplicity of parts. This ultimately gives the impression of an integral structure suggesting that the stile 20 is entirely composed of expensive wood.

To facilitate a tight fit between the stile end cap 60 and the cover 24, the stile end cap 60 includes a closed loop wall 70 that forms a tight press fit with an inner surface 72 of the stile cover 24 that is medial to the shoulder 64 as shown in FIG. 5. The periphery of the wall 70, which may be tubular or filled with material to give greater weight, is retracted with respect to the lip 66 such that the lip 66 protrudes radially with respect to the wall 70 in order to form a fringe to rest upon the shoulder 64. This facilitates the flush feature between the stile edge 62 of the stile cover 24 and the stile planar surface 68 of the stile end cap 60 so as to conceal the multiplicity of parts.

FIG. 7 is a close-up cross-sectional view illustrating the common flush feature of the stiles 20 and louvers 33 according to the invention. For purposes of clarity, the louver pin 35 (shown in FIGS. 1-4) has been removed. In FIG. 7, an end cap, such as the louver end cap 42 or stile end cap 60, is configured to mate with a tubular body, such as the stile cover 24 or louver body 44. The end cap 42, 60 includes a lip 51, 66 with a thickness T. The lip 51, 66 protrudes radially outwardly from a closed loop wall 54, 70. The closed loop wall 54, 70 extends oppositely from an outward facing planar surface 53, 68. The tubular wall 24, 44 includes an edge 46, 62 and an inner shoulder 48, 64 located at a depth medial to the edge 46, 62. The depth is substantially equal to the thickness T of the lip 51, 66 such that the shoulder 48, 64 supports the lip 51, 66 at a position wherein the planar surface 53, 68 is flush with the edge 46, 62. The closed loop wall 54, 70 also forms a tight press fit with the inner surface 56, 72 of the tubular body 24, 44 so that the end cap 42, 60 would not be easily dislodged from the tubular body 24, 44, which commonly occurs with plastic shutter assemblies in the prior art.

Not only does the stile 20 according to the invention provide the look and feel of a more expensive all wood shutter, it will be further appreciated that the stile 20 is universal in a manner that purely wood stiles are not. In particular, the stile 20 according to the invention may be employed in all types of shutter assemblies of varying dimensions. As shown in FIGS. 1 and 5, this is accomplished by the axial groove 28 which extends substantially along the length "L" of the inner core 22, thereby enabling louvers to be coupled to the stile 20 at any desired points along this length L. The cover 24 of the stile 20 may come prefabricated with apertures 31 already defined at certain points along the length L. Alternatively, to facilitate the universality of the stile 20, the cover 24 may be provided without any apertures such that an end user may simply drill holes into the cover 24 where louver connections are desired. This approach is appreciably quicker and simpler than drilling holes into a solid piece of wood. As a further alternative, serrated apertures may be preformed in the stile cover 24, thereby allowing the user to simply punch out the apertures where desired.

Accordingly, the universal stile 20 may accommodate, for example, 2-inch louvers, which would require a greater number of more closely spaced apertures in the cover 24, or four (4)-inch louvers which would require a fewer number of more distantly spaced apart apertures in the cover 24. Thus, the universal stile 20 according to the invention may accommodate any number of louvers in any manner of spacing.

If a taller shutter assembly is desired, the stile 20 may simply be formed with a greater length in order to accommodate more louvers. Alternatively, additional stiles 20 may be coupled end to end to form a longer overall stile subassembly. In any event, however, the specific structures of the core 22, particularly the axial groove 28, and the cover 24 need not be modified.

In the preferred embodiment, the plastic cover 24 of the stile 20, the stile end cap 60, the louver end cap 42 and the louver main body 44 may all be composed of a common plastic material or of different materials. As an example and not by way of limitation, this material may comprise plastic vinyl chloride (PVC) and/or nylon.

Figure 8:
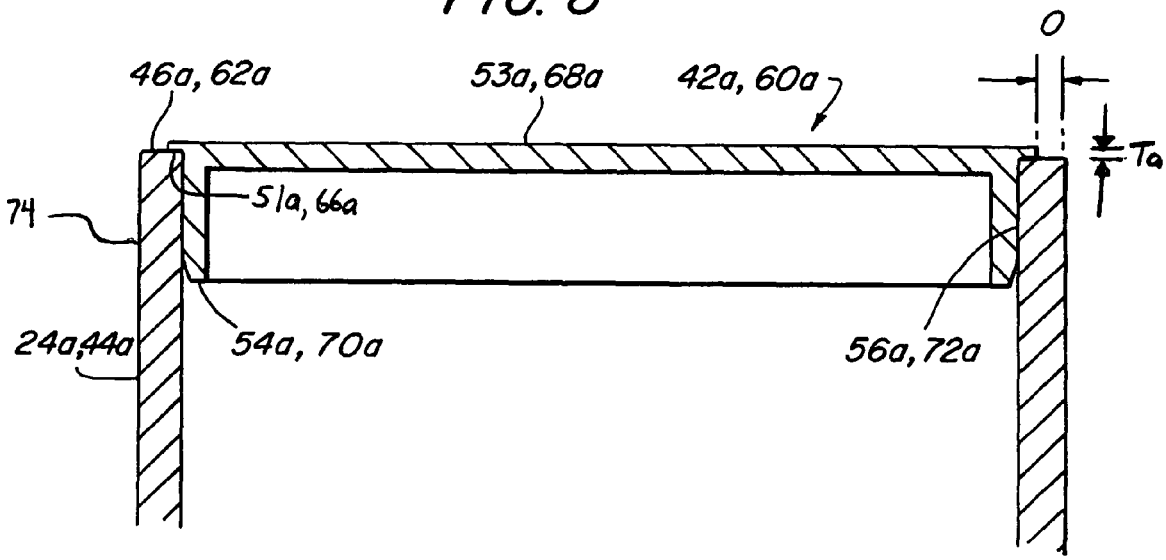
FIG. 8 is a close-up cross-sectional view illustrating a substantially flush feature of the stiles and louvers according to a further preferred embodiment of the invention.

FIG. 8 is close-up cross-sectional view illustrating the flush feature of stile end caps and louver end caps according to a further preferred embodiment of the invention. In this illustrated embodiment, elements of similar structure are designated by the same reference numerals followed by the lower case "a". For purposes of clarity, the louver pin 35 (shown in FIGS. 1-4) has been removed. In FIG. 8, an end cap, such as the louver end cap 42*a* or stile end cap 60*a*, is configured to mate with a tubular body, such as the stile cover 24*a* or louver body 44*a*. The end cap 42*a*, 60*a* includes a lip, or stop, 51*a*, 66*a* with a thickness "Ta" that is significantly thinner than those of plastic end caps in the prior art. In particular, the thickness "Ta" of the lip 51*a*, 66*a* is preferably in the range of 0.005 to 0.015 inches. The unique thinness "Ta" of this lip 51*a*, 66*a* helps to conceal the fact that the end cap 42*a*, 60*a* is a separate component from the cover 24*a*, 44*a*. Thus, the outer planar surface 53*a*, 68*a* appears flush with the edge 46*a*, 62*a* of the tubular wall 24*a*, 44*a*.

Figure 9:
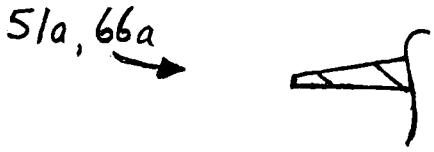
FIG. 9 is close-up cross-sectional view of a preferred peripheral lip of an end cap according to the invention.

As shown more clearly in the close-up view in FIG. 9, the lip 51*a*, 66*a* is tapered such that it has a thinner outer edge. In the preferred embodiment, the peripheral edge of the lip 51*a*, 66*a* has a thinner thickness, preferably around 0.005 inches. The thickness increases to preferably 0.015 inches in the medial portion of the lip 51*a*, 66*a*. It will be appreciated that the combination of the inward offset, shown in FIG. 8, and the tapered thickness facilitates the substantially flush appearance of the end cap, such that the end cap appears to be integral with the tubular wall 24, 44 to which it is coupled.

In this embodiment, the lip 51*a*, 66*a* protrudes radially outwardly from a closed loop wall 54*a*, 70*a* at a distance long enough to form a stop that abuts the edge 46*a*, 62*a* of the tubular wall 24*a*, 44*a* in order to prevent the cap 42*a*, 60*a* from being completely lodged therein. The lip 51*a*, 66*a*, however, extends a distance short of the outer surface 74 of the stile/louver cover 24*a*, 44*a*. Thus, the outer periphery of the lip 51*a*, 66*a* is inwardly offset by a distance "O." This inward offset "O" helps to conceal break lines from view in order to give the appearance that the entire stile or louver is composed of wood.

This inward offset "O" is preferably 50% to 95% of the thickness of the tubular wall. Plastic tubular walls generally have thickness in the range of 0.045 to 0.200 inches. Thus, as examples and not by way of limitation, the offset "O" can be as little as 0.023 inches to as much as 0.190 inches from the outer surface 74 of the tubular wall 24*a*, 44*a*.

The closed loop wall 54*a*, 70*a* extends oppositely from an outward facing planar surface 53*a*, 68*a*. The closed loop wall 54*a*, 70*a* forms a tight press fit with the inner surface 56*a*, 72*a* of the tubular body 24*a*, 44*a* so that the end cap 42, 60 would not be easily dislodged from the tubular body 24*a*, 44*a*, which commonly occurs with plastic shutter assemblies in the prior art.

Figure 10:
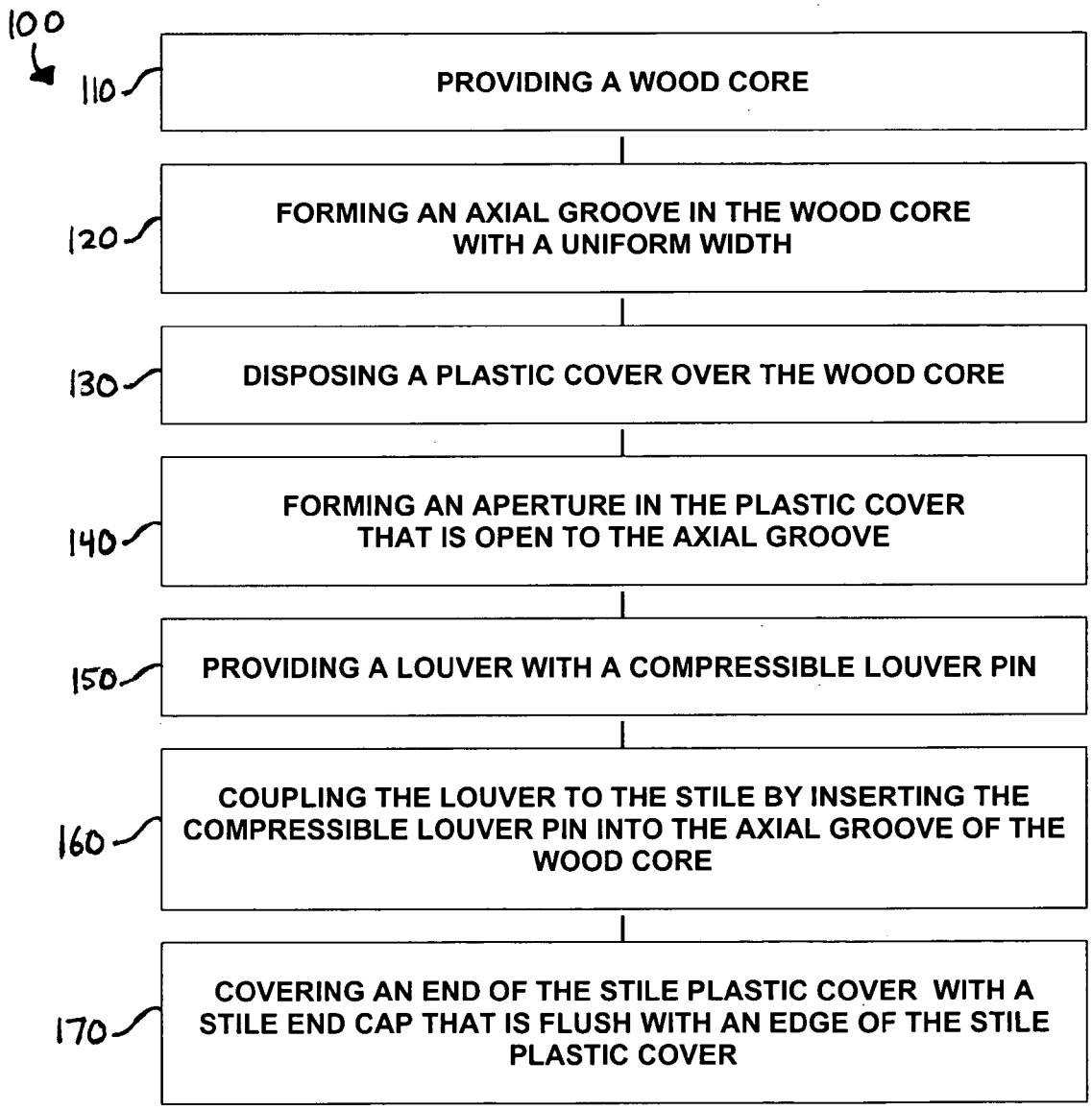
FIG. 10 is a diagram of a method of manufacturing a shutter assembly.

In FIG. 10, a method 100 of manufacturing a shutter assembly is also provided. The method 100 comprises the step 110 of providing a wood core. In step 120, an axial groove with a uniform width is formed in the wood core. Step 130 includes disposing a plastic cover over the wood core. It will be appreciated that steps 110, 120, 130 collectively form the overall step of providing a stile with a plastic cover and a wood core with an axial groove. In step 140, an aperture is formed in the plastic cover that is open to the axial groove. Step 150 includes providing a louver with a compressible louver pin. This step 150 may include forming the louver with a pair of arms with a slot therebetween to enable the arms to be compressed toward each other. The step 150 of providing the louver with the louver pin comprises providing a louver edge and a louver end cap that is flush with the louver edge.

Step 160 comprises coupling the louver to stile by inserting the compressible louver pin into the axial groove of the wood core. This step 160 involves forming a tight compression fit between the slotted louver pin and the axial groove of fixed width, while still enabling the louver to rotate freely with respect to the stile.

The method further comprises the step 170 of covering an end of the stile plastic cover with a stile end cap that is flush with an edge of the stile plastic cover.

Many alterations and modifications may be made by those having ordinary skill in the art without departing from the spirit and scope of the invention. Therefore, it must be understood that the illustrated embodiments have been set forth only for the purposes of examples and that they should not be taken as limiting the invention as defined by the following claims. For example, notwithstanding the fact that the elements of a claim are set forth below in a certain combination, it must be expressly understood that the invention includes other combinations of fewer, more or different elements, which are disclosed in above even when not initially claimed in such combinations.

The words used in this specification to describe the invention and its various embodiments are to be understood not only in the sense of their commonly defined meanings, but to include by special definition in this specification the generic structure, material or acts of which they represent a single species.

The definitions of the words or elements of the following claims are, therefore, defined in this specification to not only include the combination of elements which are literally set forth. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what incorporates the essential idea of the invention.

What is claimed is:

1. A shutter assembly comprising:

a stile defining a longitudinal axis and including a cover and an inner core, the inner core including an axial groove extending parallel to the longitudinal axis of the stile, wherein said axial groove has a width and a length, said length being greater than said width;

a louver rotatably coupled to the stile, the louver having a louver body and a louver end cap, the louver end cap comprising an outer planar surface extending in a direction generally perpendicular to a longitudinal axis of said louver body, the louver body defining a louver end surface extending in a plane which is generally co-planer with said louver end cap outer planar surface, wherein the louver end cap has a slotted compressible louver pin extending therefrom, said louver pin being received in the axial groove of the inner core of the stile, wherein at least distal ends of a pair of arms of the louver pin remain compressed by sidewalls of the axial groove to provide friction between the pair of arms and the axial groove to hold the louver in place relative to said stile.

2. The assembly of claim 1, further comprising:

a stile end cap having an outward facing stile planar surface and a lip, said lip being supported by a shoulder of the stile.

3. The assembly of claim 1, wherein the inner core of the stile is composed of wood.

4. The assembly of claim 1, wherein the cover defines a plurality of apertures open to the axial groove.

5. The assembly of claim 1, wherein the width of the axial groove is uniform throughout the length of the axial groove.

6. A shutter assembly, comprising:

a stile defining a longitudinal axis and including a plastic cover and an inner wood core, the inner wood core including an axial groove extending parallel to the longitudinal axis of the stile, wherein said axial groove has a width and a length, said length being greater than said width, the cover comprising a planar longitudinal section that faces the axial groove of the inner wood core, the planar longitudinal section defining at least one aperture open to the axial groove;

a louver rotatably coupled to the stile, the louver having a louver body and a louver end cap, the louver end cap comprising an outer planar surface extending in a direction generally perpendicular to a longitudinal axis of said louver body, the louver body defining a louver end surface extending in a plane which is generally coplanar with said louver end cap outer planer surface, wherein the louver end cap has a slotted compressible louver pin extending therefrom, said louver pin being received in the axial groove of the inner core of the stile, wherein at least distal ends of a pair of arms of the louver pin remain compressed by sidewalls of the axial groove to provide friction between the pair of arms and the axial groove to hold the louver in place relative to said stile.

7. The assembly of claim 6, further comprising:

a stile end cap having an outward facing stile planar surface and a lip, said lip being supported by a shoulder of the stile.

8. The assembly of claim 6, wherein the cover defines a plurality of apertures open to the axial groove.

9. The assembly of claim 6, wherein the width of the axial groove is uniform through the length of the axial groove.

* * * * *